US007063624B2

(12) United States Patent
Baldwin, Jr.

(10) Patent No.: US 7,063,624 B2
(45) Date of Patent: Jun. 20, 2006

(54) GOLF TRAINING APPARATUS AND METHOD OF USING THE SAME

(76) Inventor: Travis Baldwin, Jr., 6828 Toepfer Blvd., Southport, FL (US) 32409

( * ) Notice: Subject to any disclaimer, the term of this patent is extended or adjusted under 35 U.S.C. 154(b) by 0 days.

(21) Appl. No.: 10/683,307

(22) Filed: Oct. 10, 2003

(65) Prior Publication Data

US 2005/0255931 A1 Nov. 17, 2005

(51) Int. Cl.
*A63B 69/36* (2006.01)

(52) U.S. Cl. ..... 473/218; 473/219

(58) Field of Classification Search ..... 473/257, 473/219, 278, 258, 260, 261, 266, 270, 218, 473/264, 265

See application file for complete search history.

(56) References Cited

U.S. PATENT DOCUMENTS

| | | | | |
|---|---|---|---|---|
| 2,611,610 | A * | 9/1952 | Hara | 473/271 |
| 2,754,125 | A | 7/1956 | Engler | |
| 2,866,645 | A | 12/1958 | Cayot | |
| 3,312,474 | A | 4/1967 | Mitchell | |
| 3,510,136 | A | 5/1970 | Ruspoli | |
| 3,586,335 | A | 6/1971 | D'Antonio | |
| 3,656,752 | A | 4/1972 | Mariarty | |
| 3,857,570 | A | 12/1974 | Gutierrez | |
| 4,000,905 | A | 1/1977 | Shirhall | |
| 4,082,287 | A | 4/1978 | Berkey | |
| 4,355,810 | A * | 10/1982 | Rydeck | 473/218 |
| 4,765,624 | A | 8/1988 | Sprague | |
| 5,263,719 | A * | 11/1993 | Bunn | 473/261 |
| 5,282,627 | A * | 2/1994 | Beck | 473/260 |
| 5,333,875 | A | 8/1994 | Wilson | |
| 5,340,109 | A | 8/1994 | Miller | |
| 5,346,220 | A * | 9/1994 | Cooper et al. | 473/261 |
| 5,356,147 | A | 10/1994 | MacDonald | |
| 5,435,547 | A | 7/1995 | Lee | |
| 5,478,082 | A * | 12/1995 | De Knight et al. | 473/218 |
| 5,503,395 | A * | 4/1996 | Cook | 473/261 |
| 5,513,842 | A | 5/1996 | Fuss | |
| 5,855,523 | A | 1/1999 | Hatchett | |
| 5,910,053 | A | 6/1999 | Scalise | |
| 6,390,931 | B1 | 5/2002 | Gauer | |
| 6,561,920 | B1 | 5/2003 | Hamilton | |
| 2003/0130055 | A1 * | 7/2003 | Townsend, II | 473/278 |
| 2003/0190972 | A1 * | 10/2003 | Townsend, II | 473/278 |

* cited by examiner

*Primary Examiner*—Raleigh W. Chiu

(57) ABSTRACT

A golf training apparatus and a method of using the same are disclosed. In one form, a golf training apparatus includes a substrate with a lower portion and a hooded upper portion and a guide extension coupled to the lower portion. The guide extension includes a straight portion positioned substantially parallel to an edge of the lower portion and an angled portion provided at an angle relative to the edge of the lower portion. The guide extension is coupled to the lower portion at a distance away from the hooded upper portion.

21 Claims, 3 Drawing Sheets

GOLF TRAINING APPARATUS AND METHOD OF USING THE SAME

TECHNICAL FIELD

The present invention generally relates to training apparatuses and, more particularly, to a golf training apparatus and method of using the same.

BACKGROUND OF THE INVENTION

Several different approaches have been taken to assist golfers with learning proper swing techniques. For example, some novice golfers spend countless hours at driving ranges attempting to learn sound golf fundamentals. During practice, a golfer may gauge a shot based on the feel of the club at impact. For example, as the club head strikes the ball the shaft of the club transmits feedback to the user's hands letting the user know if the 'sweet spot' of the club head was contacted. Additional feedback is also provided to the golfer through observing the flight of the ball after the ball is struck. For example, a ball's flight may be straight, slicing, fading, drawing, hooking, etc. based on how the ball was contacted. A golfer usually compensates for bad shots through adjusting their set-up, swing path, grip, etc. until a desired result is achieved.

This method is counterproductive for various reasons. For example, a golfer may overcorrect or overcompensate for a hook or a slice thereby creating bad swing habits that may be difficult to correct without hiring the services of a golf instructor. Additionally, a golfer may have a difficult time repeating the same swing to produce a favorable ball flight. This may result in increased time and money spent at a practice range in an attempt to find a repeatable swing.

SUMMARY OF THE INVENTION

In accordance with teachings of the invention, a training apparatus for teaching a golf swing is disclosed. The apparatus includes a substrate including a lower portion and a hooded upper portion sized to allow passage of a portion of a golf club. The apparatus further includes a guide extension coupled to the lower portion and extending upward from the lower portion at a distance from hooded upper portion to promote passage of the golf club along a swing path.

According to another aspect of the invention, a golf training apparatus for teaching a golf swing is disclosed. The golf training apparatus for teaching a golf swing includes a single substrate formed to include a hooded upper portion and a lower portion including a guide extension. The guide extension includes an angled portion formed at an angle to cooperate with the hooded upper portion to provide a swing path.

According to a further aspect of the invention, a training apparatus for teaching a golf swing is disclosed. The apparatus includes a substrate including a lower portion and a hooded upper portion and a guide extension coupled to the lower portion and including a straight portion positioned substantially parallel to a centerline of the lower portion. The guide extension includes an angled portion provided at an angle relative to the centerline and to the lower portion at a distance away from the hooded upper portion. The apparatus further includes a turf material substantially covering the lower portion including the guide extension and an interior portion of the hooded upper portion.

According to a further aspect of the invention, a training apparatus for teaching a golfer a golf swing is disclosed. The apparatus includes a guide extension coupled to a substrate and positioned between the golfer and a swing path. The guide extension includes an elongated portion and an angled portion angled relative to the swing path.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Advantageous embodiments of the invention are illustrated in FIGS. 1–6 and provide several embodiments for providing a golf training apparatus and method of using the same. In one form, a golf training apparatus includes a first guide that works in cooperation with a second guide to allow passage of a golf club to produce a consistent golf swing when employed by a user. In a particularized form, a golf training apparatus includes a substrate having a hooded upper portion that includes an open region or cavity to allow passage of a golf club head. The hooded upper portion cooperates with a guide extension coupled to a lower portion. The guide extension includes a height that extends upward from the lower portion and is placed at a distance from the hooded upper portion to assist with promoting a proper swing path.

Figure 1:
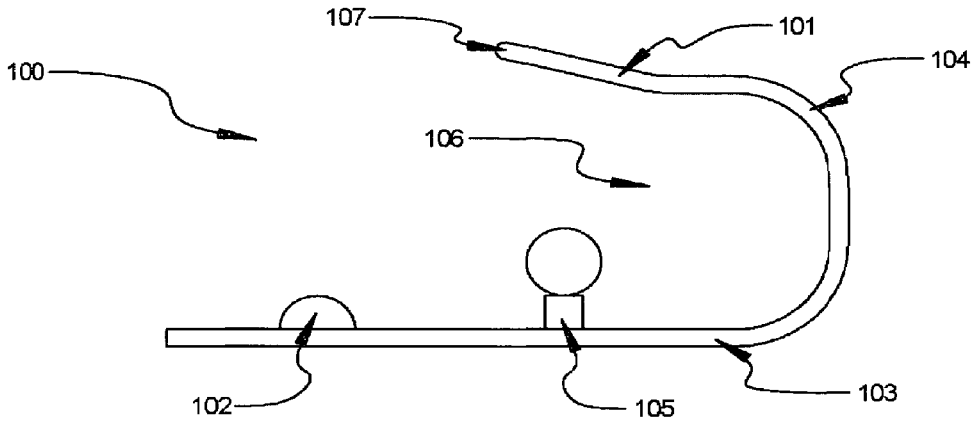
FIG. 1 illustrates a rear perspective view of a golf training apparatus according to one aspect of the invention.

FIG. 1 illustrates a rear perspective view of a golf training apparatus according to one aspect of the invention. Golf training apparatus 100 includes a lower portion 103 and a hooded upper portion 101. Lower portion 103 includes a guide extension 102 protruding from lower portion 103 and formed as a guide and cooperates with hooded upper portion 101 to allow for passage of a golf club through cavity 106. Hooded upper portion 101 is illustrated as including a cavity 106 formed from a material or substrate 104 that is provided with a tongue 107 that extends in an upward direction relative to lower portion 103. In other embodiments, tongue 107 may be extended at other angles (i.e. level, downward, vertical, etc.).

Golf training apparatus 100 further includes a ball holder 105 such as a golf tee that may include a plastic material sized to hold a golf ball. Hooded upper portion 101 is formed to provide cavity 106 to allow a golf club to pass through hooded upper portion 101 to strike a golf ball positioned along lower portion 103 or a ball positioned on ball holder 105.

In one embodiment, golf training apparatus 100 may be provided as a single substrate formed of one continuous piece of material. For example, hooded upper portion 101 and lower portion 103 may be formed from one continuous piece of material such as a fiberglass material, PVC material, Kevlar material, graphite material, or other materials or combinations of material such as wood, metals, plastics, composite materials and the like.

Figure 2:
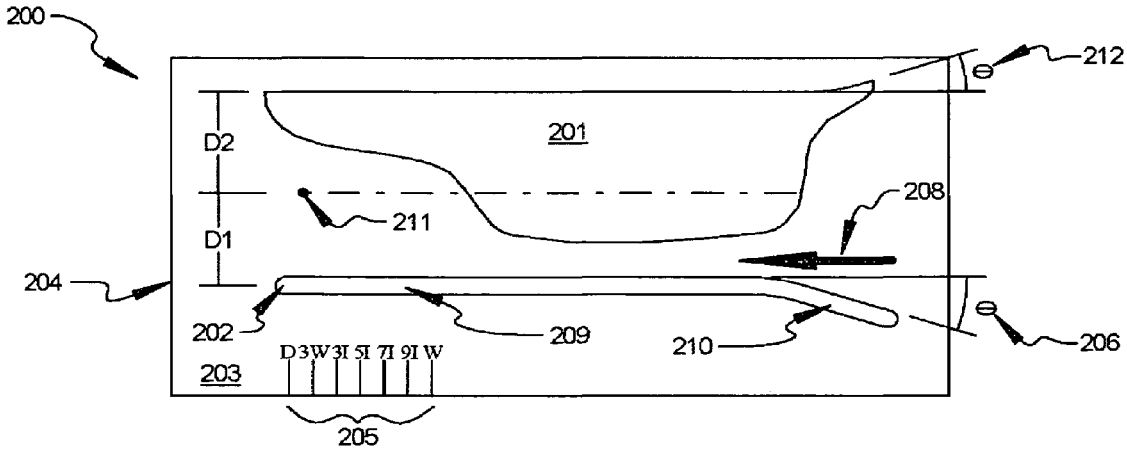
FIG. 2 illustrates a top perspective view of a golf training apparatus according to one aspect of the invention.

FIG. 2 illustrates a top perspective view of a golf training apparatus according to one aspect of the invention. A golf training apparatus 200 includes a hooded upper portion 201 coupled to a lower portion 203. A guide extension 202 is provided in cooperation with hooded upper portion 201 to facilitate providing a consistent swing path 208.

In other embodiment, hooded upper portion 201 and/or guide extension 202 may be provided as modular portions of golf training apparatus 200 and may be removably coupled to lower portion 203 using one or more coupling mechanisms such as a tongue and groove coupling, nuts, bolts, wing nuts, guides with locking pins, or any other type of coupling mechanism or combination of coupling mechanisms that may facilitate removing and coupling hooded upper portion 201 and guide extension 202.

In one embodiment, guide extension is provided relative to a centerline 211 associated with golf training apparatus 200. Centerline 211 as illustrated extends along the lower portion and may or may not be visually provided as a part of golf training apparatus 200 but is depicted to illustrate a reference location along lower portion 203 for positioning guide extension 202 and hooded upper portion 201. Other portions, such as a lower edge, upper edge, side, etc. of golf training apparatus 200 may be used to provide relative positioning for guide extension 202 and hooded upper portion 201.

In one embodiment, centerline 211 may be used to position guide extension at a distance $D_1$, such as between one inches and seven inches, and hooded upper portion 201 may be provided at a distance $D_2$, such as one inch to six inches relative to centerline 211. As such, guide extension 202 and hooded upper portion may be coupled to lower portion 203 relative to centerline 211. However, in other embodiment hooded upper portion 201 and guide extension 202 may be coupled to lower portion 203 using other positions or points of reference as needed. In one embodiment, centerline 211 may also be used to couple a golf tee (not expressly shown) to lower portion 203.

In other embodiment, angled portion 210 may be provided as a gradually curved portion (not expressly shown) that include a shape similar to an arc. As such, swing path 208 may be provided along an arched and as such angled portion 210 would not be limited to a specific angle as angled portion 210 extends from parallel portion 209.

Lower portion 203 further includes markings 205 for indicating location(s) to position a ball along lower portion 203 based on which golf club is being used. For example, markings may include ball locations for use of woods, irons, etc. to assist a golfer with obtaining a proper set-up. A foot position or a center position (not expressly shown) may also be provided to indicate where a golfer should be centered relative to golf training apparatus 200.

Guide extension 202 also includes a parallel portion 209 that is positioned substantially parallel to centerline 211 at a distance $D_1$ of approximately one inches to seven inches. Angled portion 210 is provided at angle 206 relative to parallel portion 209 or centerline 211 at approximately two and a half degrees to four degrees. Other angles may also be considered depending on a desired swing path 208. Hooded upper portion 201 cooperates with guide extension 202 to provide a swing path 208. Guide extension 202 provides feedback to a user through contacting the heel of a golf club during a backswing and downswing providing a user feedback and guiding the user's swing along swing path 208. Guide extension 202 also provides a visual feedback to the user through displaying a maximum angle via angled portion 210. For example, a user is encouraged to follow the same swing path during a back-swing and/or down-swing based on swing path 208.

Hooded upper portion 201 works in association with guide extension 202 to inhibit a user from lifting a golf club (not expressly shown) in an upward direction during a back swing thereby ensuring a user moves golf club along lower portion 203. Additionally, hooded upper portion 201 includes a hood angle 212 provided relative to centerline 211. For example, hooded angle 212 may be provided at a gradually increasing angle between approximately zero degrees and four degrees or more relative to centerline 211 allowing for a slight outside-to-inside swing of a golf club during use. As such, golf training apparatus 200 may include two guides (i.e. guide extension 202 and hooded upper portion 201) with each having different guide angles to provide a swing path.

Upon a user swinging in a downward direction, hooded upper portion 201 inhibits a user from swinging down or over a golf ball (i.e. swinging over the top or across swing path 208) causing the golf club to contact hooded upper portion 201.

During use, a user may place a golf ball along lower portion 203 based on the type of golf club being used and relative to markings 205. For example, if a user is using a nine iron, the user may place a golf ball to align with a nine iron indicia of markings 205. Similarly, if a user is practicing with a six iron, the user may place a ball between a five iron and seven iron indicia of markings 205. In this manner, a golfer may position a golf ball along lower portion 203 as needed.

In one embodiment, golf training apparatus 200 may include instructions (not expressly shown) printed on top of hooded upper portion 201 and/or lower portion 203. Printed instructions may include set-up instructions, swing thoughts, etc. to assist a user with having a consistent swing thoughts during set-up and execution phases of a golf swing. Additionally, an instructional video may also be provided in association with golf training apparatus 200 to aid a user in determining how to use golf training apparatus 200.

Upon a user establishing a proper set-up and placing a golf ball in a desired position on lower portion 203 of golf training apparatus 200, a user begins a take away through moving a golf club (not expressly shown) between guide extension 202 and hooded upper portion 201. Hooded upper portion 201 cooperates with guide extension 202 to ensure a user moves a golf club low to the ground (i.e. user cannot pick up or lift a golf club) and along a specific path as provided by guide extension 202. Additionally, hooded upper portion 201 and guide extension 202 also limit or prevent a user from swinging 'inside-to-outside' or 'outside-to-inside' and promotes a user to swing along swing path 208. In this manner, a proper back swing may be achieved as a user begins a golf swing.

As the user begins a downswing, the user must travel along swing path 208 to ensure the golf club does not contact hooded upper portion 201 or guide extension 202. If a user successfully navigates along swing path 208, the head of the golf club contacts a golf ball. In this manner, a consistent and repeatable swing may be achieved using golf training apparatus 200.

In another embodiment, guide extension 202 may be provided without hooded upper portion 201 or hooded upper portion 201 may be provided without guide extension 202. For example, hooded upper portion 201 may be removable allowing a user to remove hooded upper portion 201 during use. As such, a user may utilize guide extension 202 during practice. In this manner, golf training apparatus may be realized using guide extension 202 or hooded upper portion 201.

Figure 3:
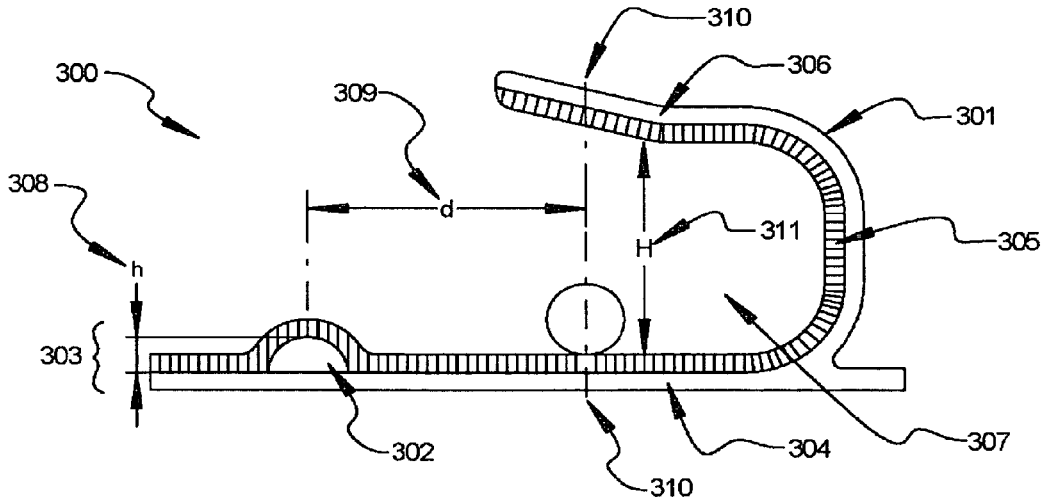
FIG. 3 illustrates a rear perspective view of a golf training apparatus according to one aspect of the invention.

FIG. 3 illustrates a rear perspective view of a golf training apparatus according to one aspect of the invention. Golf training apparatus 300 includes a hooded upper portion 301 and a lower portion 303 including a guide extension 302. Golf training apparatus 300 further includes an artificial grass or turf 305 coupled to substrate 304. Guide extension 302 may also include a padded material (not expressly shown) and turf 305 covering guide extension 302. In another embodiment, turf 305 may be coupled to interior portion 306 of hooded upper portion 301 and may provide protection for a top surface of a golf club. In other embodiments, other types of padding or protective materials may also be used to protect a top portion of a golf club.

Guide extension 302 is formed at a specific guide extension height (h) 308 to impede passage of a golf club if a proper swing is not initiated. For example, guide extension 302 may be formed in a semi-circle having a specific guide extension height (h) 308 ranging from one and a half inches to four inches. Additionally, guide extension 302 may be placed at a distance (d) 309 from hooded upper portion 301 and may range from five inches to nine inches relative to a centerline 310.

Hooded upper portion 301 may also be provided at a hooded upper portion height (H) 311 from lower portion 303 relative to centerline 310 to produce a cavity 307 for allowing passage of a golf club. For example, hooded upper portion 301 may range from four inches to nine inches from lower portion 303.

In one embodiment, hooded upper portion 301 may be variable to provide a variable sized cavity 307. For example, various sized golf clubs are readily available to golfers. As such, through providing variable size aperture 307 a user may adjust the size as needed. Additionally, as a user's skill level increases, cavity 307 may be varied based on the user's skill level.

In one embodiment, various combinations and sizes of hooded upper portion 301 and guide extension 302 may be used to provide a user various configurations for golf training apparatus 300. For example, guide extension 302 having a height of three inches may be used with a hooded upper portion 301 having a height of seven inches. Other dimensions and/or combinations of dimension may also be employed. In one embodiment, guide extension 302 may be provided with a tapered or sloping height. For example, height (h) may increase and/or decrease along different portions or locations of lower portion 304 as guide extension 302 extends along lower portion 304.

Figure 4:
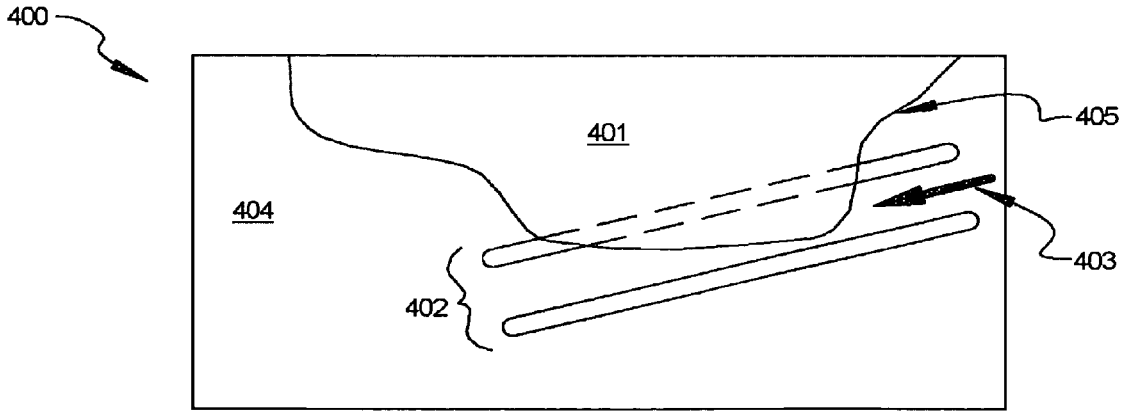
FIG. 4 illustrates a top perspective view of golf training apparatus for providing an 'outside-to-inside' swing path according to one aspect of the invention.

FIG. 4 illustrates a top perspective view of golf training apparatus for providing an 'outside-to-inside' swing path according to one aspect of the invention. A golf training apparatus 400 includes a hooded upper portion 401 coupled to a lower portion 404 including a pair of guide extensions 402 positioned to promote a swing path 403 operable to produce a slicing or fading ball flight. Hooded upper portion 401 may further include a cut away 405 that cooperates with extensions 402 to provide swing path 403.

During use, a user places a ball along and between guide extensions 402. The user remains substantially parallel to lower portion 404 of golf training apparatus 400 and begins a swing along swing path 403 to produce an 'outside-to-inside' swing plane. During a downswing as a golf club approaches golf training apparatus 400, a user is forced to swing along swing path 403 to contact a golf ball to produce a slice or fade. In this manner, a user is able to practice or learn a proper swing path to fade or slice a golf ball. Although golf training apparatus 400 is illustrated as having a pair of guide extensions 402, it should be understood that a single extension, plural extensions or no extension at all may be used in association with hooded upper portion 401 to provide swing path 403.

Figure 5:
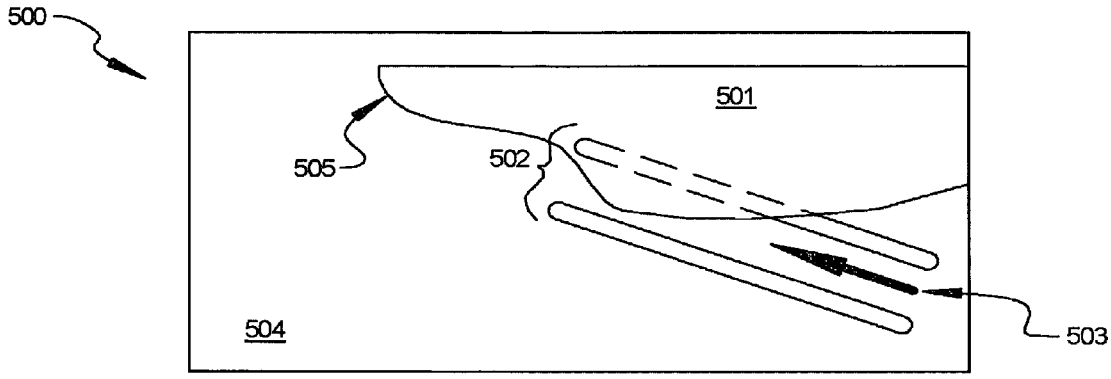
FIG. 5 illustrates a top perspective view of a golf training apparatus for providing an 'inside-to-outside' swing path according to one aspect of the invention.

FIG. 5 illustrates a top perspective view of a golf training apparatus for providing an 'inside-to-outside' swing path according to one aspect of the invention. A golf training apparatus includes a hooded upper portion 501 coupled to a lower portion 504 including a pair of guide extensions 502 positioned to promote a swing path 503 operable to produce a hooking or drawing ball flight. Hooded upper portion 501 may further include a cut away 505 that cooperates with extensions 502 to provide swing path 503. Lower portion 504 also extends beyond hooded upper portion 501.

During use, a user places a ball along and between guide extensions 502. The user remains substantially parallel to lower portion 504 of golf training apparatus 500 and begins a swing along swing path 503 to produce an 'inside-to-outside' swing plane. During a downswing, as the golf club approaches golf training apparatus 500, a user is forced to swing along swing path 503 and to contact a ball and produce a hook or draw. In this manner, a user is able to practice or learn a proper swing path to draw or hook a golf ball. Although golf training apparatus 500 is illustrated as having a pair of guide extensions 502, it should be understood that a single extension, plural extensions or no extension at all may be used in association with hooded upper portion 501 to provide swing path 503.

Figure 6:
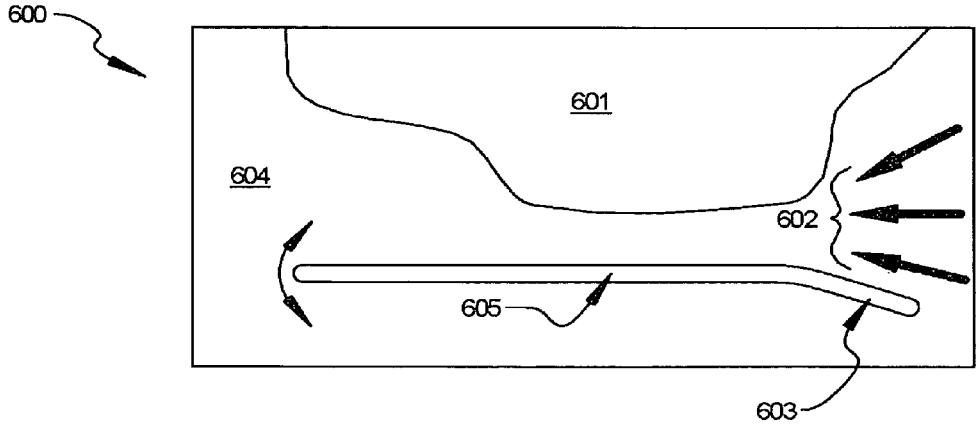
FIG. 6 illustrates a top perspective view of a golf training apparatus for providing a variable swing path according to one aspect of the invention.

FIG. 6 illustrates a top perspective view of a golf training apparatus for providing a variable swing path according to one aspect of the invention. A golf training apparatus 600 includes a hooded upper portion 601 coupled to a lower portion 604 including a positionable guide extension 603 that may be positioned to promote one of swing paths 603. Hooded upper portion 601 cooperates with positionable guide extension 603 to provide a swing path to produce a desired ball flight (i.e. straight, draw, fade, etc.).

During use, a user may position positionable guide extension 603 to practice a type of shot desired. For example, a user may rotate the guide in a counterclockwise direction to place guide 603 in a position to practice a slice or moved in a clockwise direction to practice a hook.

Positionable guide extension 603 may be held in place with a tension fitting such as a rivet, nut and bolt, etc. at pivot point 605. However in other embodiments, one or more coupling mechanisms may be used to couple positionable guide extension 603 to lower portion 604 and produce a desired swing path. For example, a coupling mechanism such as a pin with a series of pin holes (not expressly shown) for receiving a pin placed through positionable guide extension 603 to be coupled to lower portion 604 at a fixed position. In this manner, a user may practice a variety of swings and swing angles as needed.

Although FIGS. 1–6 illustrate a golf training apparatus for assisting right handed golfers it should be understood that each of the embodiments disclosed may be altered to provide a golf training apparatus for left handed golfers. Additionally, although the disclosed embodiments have been described in detail, it should be understood that various changes, substitutions and alterations can be made to the embodiments without departing from their spirit and scope.

What is claimed is:

1. A training apparatus for teaching a golf swing comprising:

a substrate including a lower portion and a hooded upper portion covering a portion of a centerline of a swing path sized to allow passage of a portion of a golf club; and a guide extension coupled to the lower portion and extending upward from the lower portion at a distance from hooded upper portion and away from the hooded upper portion to promote passage of the golf club along a swing path.

2. The apparatus of claim 1 further comprising the guide extension positioned at a distance away from the hooded upper portion.

3. The apparatus of claim 2 further comprising the guide extension including a height relative to the hooded upper portion to allow passage of the golf club along the swing path.

4. The apparatus of claim 1 wherein the guide extension comprises:

a substantially straight portion positioned along the lower portion; and an angled portion angled relative to the straight portion.

5. The apparatus of claim 1 further comprising artificial turf material coupled to at least the lower portion of the substrate.

6. The apparatus of claim 1 further comprising the guide extension including a padded material used to form the guide extension at specific height.

7. The apparatus of claim 1 further comprising the guide extension including a substantially straight portion and an arced portion.

8. The apparatus of claim 1 further comprising the substrate including an epoxy material.

9. The apparatus of claim 1 further comprising a padded material coupled to an interior portion of the hooded upper portion.

10. The apparatus of claim 1 further comprising the hooded upper portion including at least one tapered portion.

11. The apparatus of claim 1 further comprising a golf tee coupled to the lower portion.

12. The apparatus of claim 1 further comprising markings along a portion of the lower portion.

13. The apparatus of claim 1 further comprising the guide extension formed at an angle to promote an inside-to-outside swing path.

14. The apparatus of claim 1 further comprising the guide extension formed at an angle to promote an outside-to-inside swing path.

15. A golf training apparatus for teaching a golf swing comprising:

a single substrate formed to include a hooded upper portion and a lower portion including a guide extension, said hooded upper portion covering a portion of a centerline of a swing path and the guide extension including an angled portion formed at an angle to cooperate with the hooded upper portion to provide a swing path of a golf club.

16. The apparatus of claim 15 further comprising an adjustable hooded upper portion.

17. The apparatus of claim 15 further comprising the guide extension as a positionable guide extension.

18. The apparatus of claim 15 further comprising:

a padded material coupled to an interior portion of the hooded upper portion; and a turf material coupled to the lower portion and covering at least a portion of the guide extension.

19. The apparatus of claim 15 further comprising a turf material coupled to the lower portion and an interior portion of the hooded upper portion.

20. The apparatus of claim 15 further comprising the upper portion and lower portion including a turf material.

21. A training apparatus for teaching a golf swing comprising:

a substrate including a lower portion and a hooded upper portion covering a portion of a centerline of a swing path;

a guide extension coupled to the lower portion and including a straight portion positioned substantially parallel to a centerline of the lower portion, the guide extension including an angled portion provided at an angle relative to the centerline, the guide extension coupled to the lower portion at a distance away from the hooded upper portion; and a turf material substantially covering the lower portion including the guide extension and an interior portion of the hooded upper portion.

* * * * *